US008410693B2

(12) United States Patent
Mizuno et al.

(10) Patent No.: US 8,410,693 B2
(45) Date of Patent: Apr. 2, 2013

(54) PLASMA DISPLAY PANEL

(75) Inventors: Koichi Mizuno, Shiga (JP); Shinichiro Hori, Osaka (JP); Eishiro Otani, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/321,620

(22) PCT Filed: Feb. 1, 2011

(86) PCT No.: PCT/JP2011/000538

§ 371 (c)(1),
(2), (4) Date: Nov. 21, 2011

(87) PCT Pub. No.: WO2011/096191

PCT Pub. Date: Aug. 11, 2011

(65) Prior Publication Data

US 2012/0293065 A1 Nov. 22, 2012

(30) Foreign Application Priority Data

Feb. 8, 2010 (JP) ..... 2010-025078

(51) Int. Cl.
*H01J 17/49* (2006.01)

(52) U.S. Cl. ..... 313/581; 313/584

(58) Field of Classification Search ..... None
See application file for complete search history.

(56) References Cited

U.S. PATENT DOCUMENTS

| | | | | |
|---|---|---|---|---|
| 7,009,587 | B2 | 3/2006 | Nishimura | |
| 7,385,352 | B2 * | 6/2008 | Yoo | 313/587 |
| 7,432,655 | B2 * | 10/2008 | Yoo et al. | 313/586 |
| 2004/0000871 | A1 | 1/2004 | Higashi | |
| 2004/0032215 | A1 * | 2/2004 | Nishimura et al. | 315/169.3 |
| 2005/0040767 | A1 * | 2/2005 | Yoo et al. | 313/587 |
| 2005/0068267 | A1 | 3/2005 | Yoshioka | |
| 2005/0264199 | A1 * | 12/2005 | Kwon et al. | 313/582 |
| 2006/0284559 | A1 * | 12/2006 | Naoi et al. | 313/586 |
| 2009/0102378 | A1 * | 4/2009 | Fujitani et al. | 313/582 |
| 2009/0289543 | A1 | 11/2009 | Chung | |

FOREIGN PATENT DOCUMENTS

| | | |
|---|---|---|
| JP | 10144225 | 5/1998 |
| JP | 2005005188 | 1/2005 |
| JP | 2006196223 | 7/2006 |
| JP | 2009283160 | 12/2009 |
| JP | 2009283432 | 12/2009 |
| WO | WO 0217345 A1 | 2/2002 |

OTHER PUBLICATIONS

International Application No. PCT/JP2011/000538, International Search Report mailed Apr. 5, 2011, 2 pgs.

* cited by examiner

*Primary Examiner* — Ashok Patel
(74) *Attorney, Agent, or Firm* — RatnerPrestia

(57) ABSTRACT

A plasma display panel includes a rear plate and a front plate arranged as opposed to the rear plate. The rear plate has a vertical barrier rib and a horizontal barrier rib orthogonal to the vertical barrier rib. The front plate has a first transparent electrode in parallel with the horizontal barrier rib and a plurality of second transparent electrodes in parallel with the vertical barrier rib. The front plate further has a plurality of bus electrodes having the same width and arranged with the same interval. The plurality of bus electrodes includes a first bus electrode electrically connected with the first transparent electrode, and a second bus electrode electrically connected with the plurality of second transparent electrodes. The second bus electrode is formed in a position opposed to the horizontal barrier rib.

5 Claims, 6 Drawing Sheets

PLASMA DISPLAY PANEL

This application is a U.S. National Phase Application of PCT International application No. PCT/JP2011/000538.

TECHNICAL FIELD

A technique of the present disclosure relates to a plasma display panel used for a display device.

BACKGROUND ART

A plasma display panel (hereinafter referred to as a PDP) has a configuration where a pair of substrates is arranged as opposed to each other such that a discharge space is formed therebetween. The discharge space is partitioned into a plurality of spaces with barrier ribs arranged on the substrate, to constitute a plurality of discharge cells. In order to generate discharge in the discharge space sectioned with the barrier ribs, a display electrode and a data electrode are arranged on the substrate. Phosphors that emit red, green or blue light by discharge are provided on the substrate. The PDP excites the phosphors by means of ultraviolet light generated by discharge, and respectively emits red, green and blue visible light from the discharge cells, to display an image.

In the PDP, the display electrode is configured by superimposition of a wide, band-like transparent electrode and a bus line as a metal electrode, so as to increase light-emitting luminance at the time of image display. Hence an area of the display electrode increases. In order to suppress a discharge current that increases due to this configuration, or to eliminate the transparent electrode for reduction in number of steps, a display electrode divided into a plurality of portions and provided with openings has been used (e.g., refer to Patent Literature 1).

CITATION LIST

Patent Literature

[Patent Literature 1] International Patent Publication No. 02/017345

SUMMARY OF THE INVENTION

A plasma display panel is provided with a rear plate and a front plate arranged as opposed to the rear plate. The rear plate has a vertical barrier rib and a horizontal barrier rib orthogonal to the vertical barrier rib. The front plate has a first transparent electrode in parallel with the horizontal barrier rib and a plurality of second transparent electrodes in parallel with the vertical barrier rib. The front plate further has a plurality of bus electrodes having the same width and arranged with the same interval. The plurality of bus electrodes includes a first bus electrode electrically connected with the first transparent electrode, and a second bus electrode electrically connected with the plurality of second transparent electrodes. The second bus electrode is formed in a position opposed to the horizontal barrier rib.

DETAILED DESCRIPTION OF PREFERRED EMBODIMENTS EXEMPLARY EMBODIMENT

First, an overall configuration of PDP 100 according to the present exemplary embodiment will be described with reference to FIGS. 1 to 3.

Figure 1:
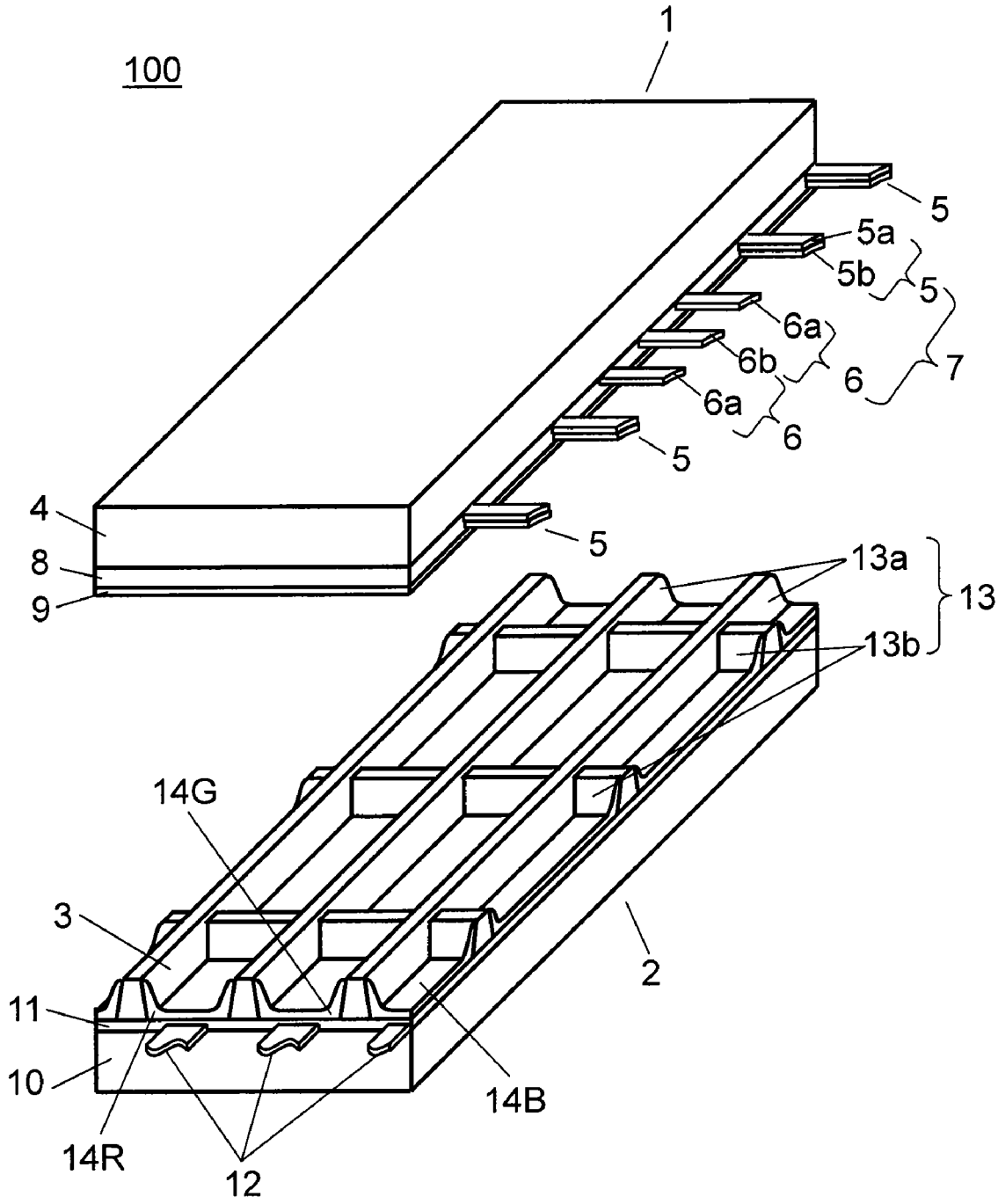
FIG. 1 is an exploded perspective view showing a PDP according to the present exemplary embodiment.

As shown in FIG. 1, PDP 100 is configured of front plate 1 and rear plate 2.

Front plate 1 is made up of substrate 4, display electrodes 7, dielectric layer 8 and protective layer 9. A plurality of conductive display electrodes 7 is arrayed in a row direction on glass-made substrate 4. Display electrode 7 is made up of scan electrode 5 and sustain electrode 6. Scan electrode 5 and sustain electrode 6 are arranged in parallel with each other with a discharge gap provided therebetween. Scan electrode 5 and sustain electrode 6 are formed in an order of scan electrode 5, sustain electrode 6, sustain electrode 6 and scan electrode 5. Dielectric layer 8 made of a glass material is formed so as to cover scan electrode 5 and sustain electrode 6. Protective layer 9 made of magnesium oxide (MgO) is formed on dielectric layer 8.

Figure 2:
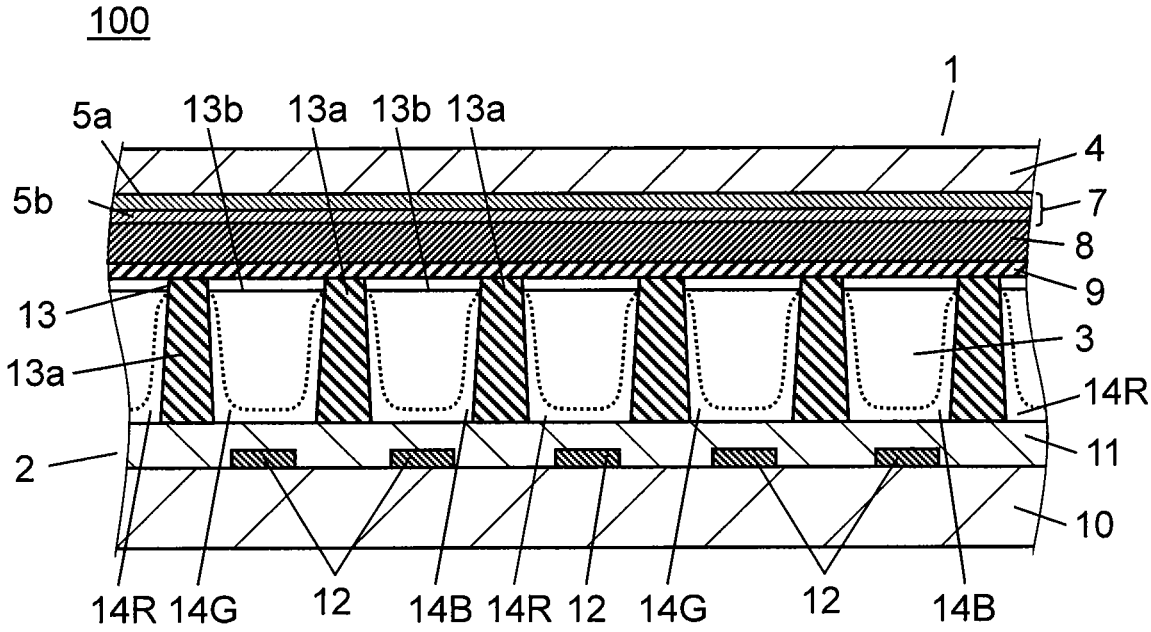
FIG. 2 is a sectional view showing a configuration of discharge cell portions of the PDP according to the present exemplary embodiment.

As shown in FIG. 2, scan electrode 5 has first transparent electrode 5*a* in parallel with horizontal barrier rib 13*b*, and first bus electrode 5*b* electrically connected with first transparent electrode 5*a*.

Figure 6:
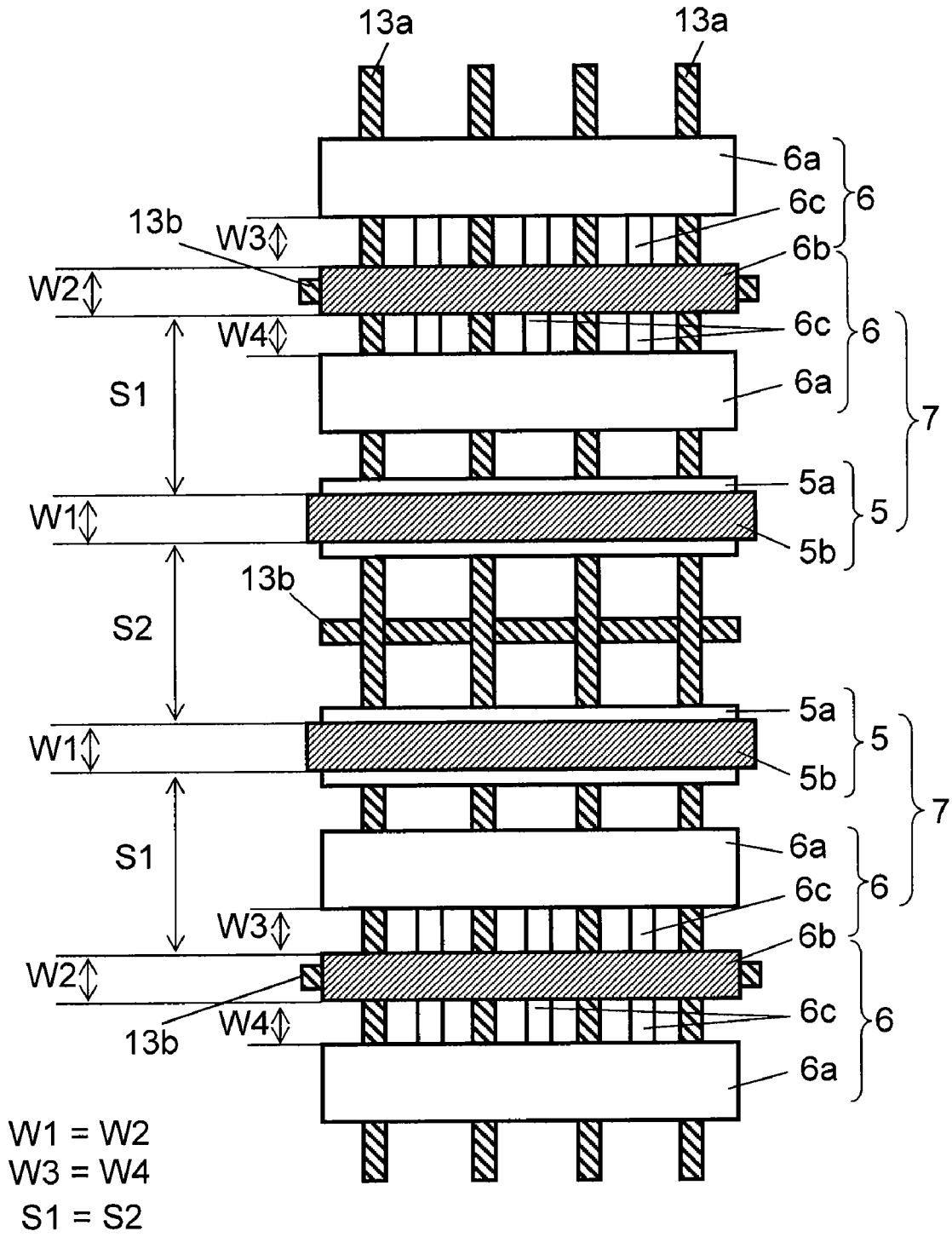
FIG. 6 is a plan view showing an arrangement relation among scan electrodes and sustain electrodes, which constitute display electrodes, and barrier ribs in the PDP according to the present exemplary embodiment.

As shown in FIG. 6 later, sustain electrode 6 has a plurality of second transparent electrodes 6*c* in parallel with vertical barrier rib 13*a*, second bus electrode 6*b* electrically connected with the plurality of second transparent electrodes 6*c*, and third transparent electrode 6*a* in parallel with horizontal barrier rib 13*b*. Second bus electrode 6*b* is formed in a position opposed to horizontal barrier rib 13*b*.

Herein, a plurality of first bus electrodes 5*b* and second bus electrodes 6*b* has the same width and are arranged with the same interval.

First transparent electrode 5*a*, second transparent electrode 6*c* and third transparent electrode 6*a* are indium tin oxide (ITO) or the like. First bus electrode 5*b* and second bus electrode 6*b* each include a black pigment, the glass material and a conductive metal such as silver (Ag). The configurations of scan electrode 5 and sustain electrode 6 will be described in detail later.

As shown in FIG. 1, rear plate 2 is made up of substrate 10, insulating layer 11, data electrodes 12, barrier ribs 13 and phosphor layers 14R, 14G, 14B. A plurality of lines of data electrodes 12 made of Ag is provided on glass-made substrate 10. Data electrodes 12 are arrayed in stripes in a column direction. Data electrode 12 is covered with insulating layer 11 made of the glass material. Parallel-cross barrier ribs 13 made of the glass material are provided on insulating layer 11.

Barrier ribs 13 have vertical barrier rib 13*a* and horizontal barrier rib 13*b* orthogonal to vertical barrier rib 13*a*. Discharge space 3 formed between front plate 1 and rear plate 2 is partitioned with respect to each discharge cell 15. Red (R), green (G) and blue (B) phosphor layers 14R, 14G, 14B are each provided on a front face of insulating layer 11 and side faces of barrier ribs 13.

Herein, as shown in FIG. 2, parallel-cross barrier ribs 13 to form discharge cells 15 are made up of vertical barrier ribs 13*a* and horizontal barrier ribs 13*b*. Vertical barrier rib 13*a* is formed in parallel with data electrode 12. Horizontal barrier rib 13*b* is formed so as to be orthogonal to vertical barrier rib 13*a*. Phosphor layers 14R, 14G, 14B are applied inside barrier ribs 13 in stripes along vertical barrier rib 13*a*. Phosphor layers 14R, 14G, 14B are arrayed in an order of blue phosphor layer 14B, red phosphor layer 14R and green phosphor layer 14G.

Then, front plate 1 and rear plate 2 are arranged as opposed to each other such that scan electrode 5 and sustain electrode 6 intersect with data electrode 12. As shown in FIG. 3, discharge cell 15 is provided in an area where scan electrode 5 and sustain electrode 6 intersect with data electrode 12. Discharge space 3 is filled, for example, with a mixed gas of neon and xenon as a discharge gas. It is to be noted that the structure of PDP 100 is not restricted to the one described above. The structure of PDP 100 may be one provided with striped barrier ribs, for example.

Scan electrodes 5 are made up of n-lines of scan electrodes Y1, Y2, Y3 . . . Yn extending in the row direction. Sustain electrodes 6 are made up of n-lines of sustain electrodes X1, X2, X3 . . . Xn extending in the row direction. Data electrodes 12 are made up of m-lines of data electrodes A1 . . . Am extending in the column direction. Discharge cell 15 is formed in an area where scan electrode Yp and sustain electrode Xp in a pair ($1 \leqq p \leqq n$) intersect with one line of data electrode Aq ($1 \leqq q \leqq m$). m×n pieces of discharge cells 15 are formed inside discharge space 3. Scan electrode 5 and sustain electrode 6 are formed on front plate 1 in a pattern of scan electrode Y1, sustain electrode X1, sustain electrode X2, scan electrode Y2 . . . . Scan electrode 5 and sustain electrode 6 are connected to a terminal of a drive circuit provided outside an image display area formed with discharge cells 15.

Next, an overall configuration and a driving method of plasma display device 200 will be described using foregoing PDP 100.

Figure 3:
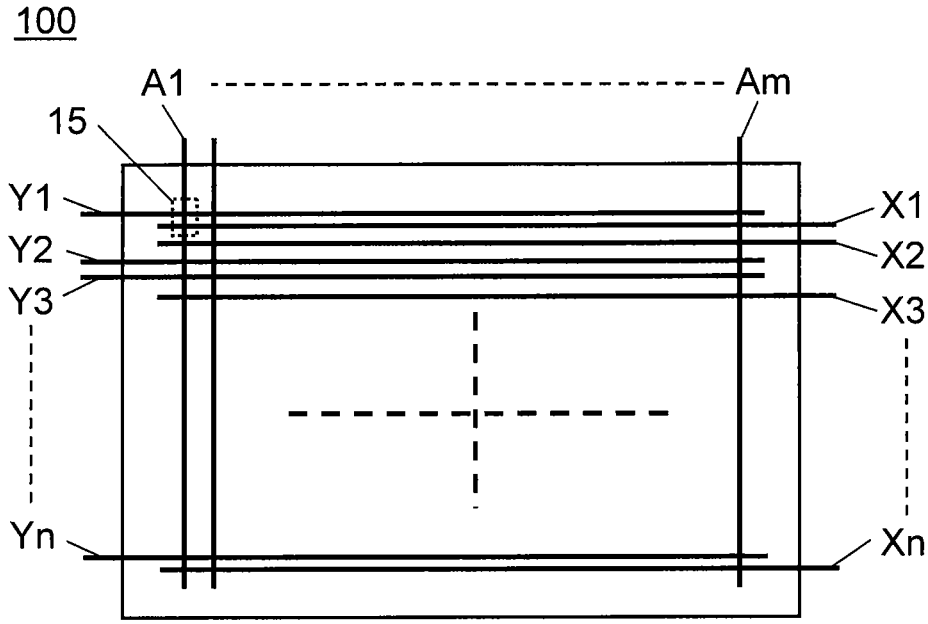
FIG. 3 is an electrode array diagram of the PDP according to the present exemplary embodiment.
Figure 4:
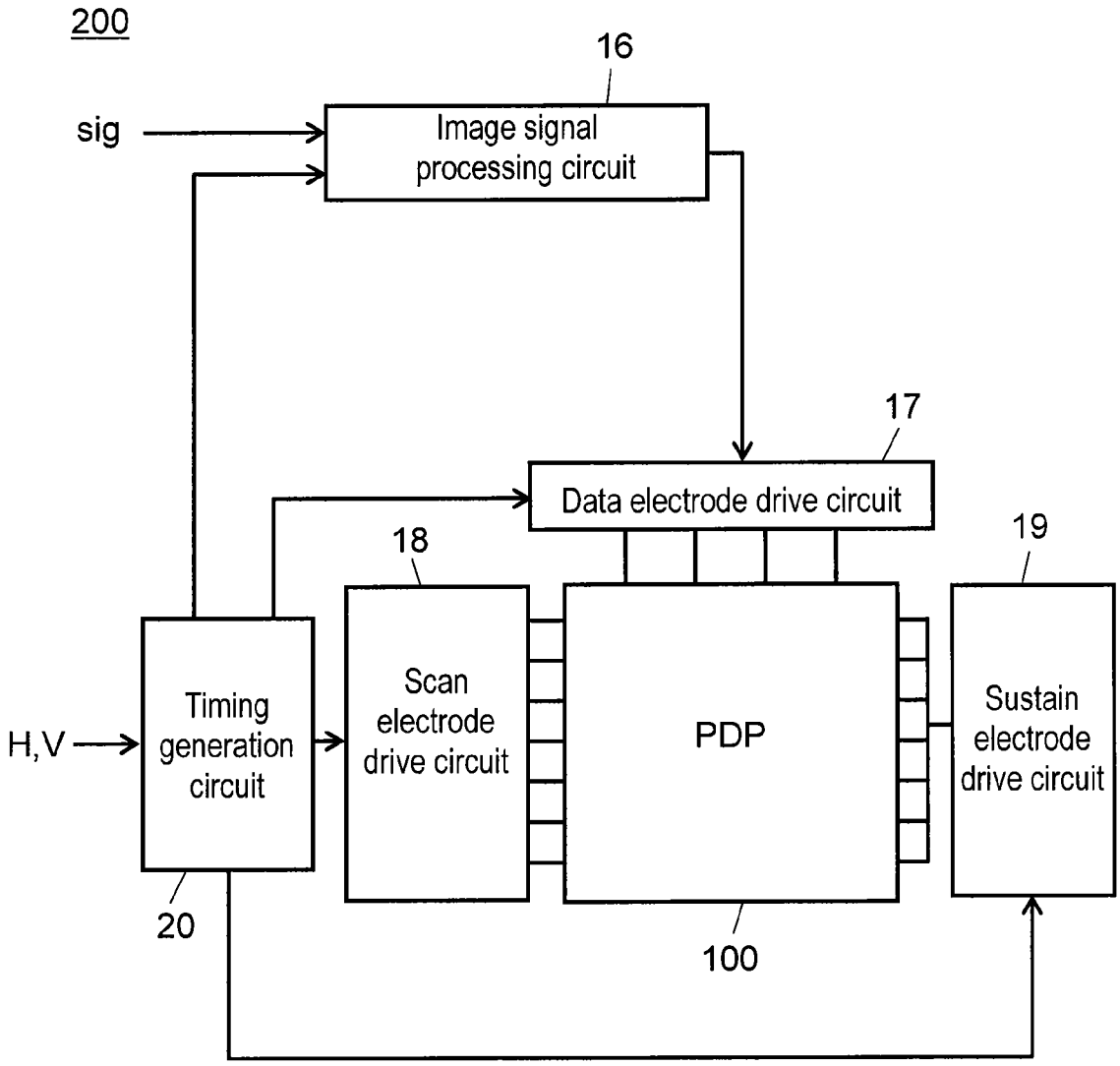
FIG. 4 is a block diagram showing an overall configuration of a plasma display device using the PDP according to the present exemplary embodiment.

As shown in FIG. 4, plasma display device 200 is provided with PDP 100 having the configuration shown in FIGS. 1 to 3, image signal processing circuit 16, data electrode drive circuit 17, scan electrode drive circuit 18, sustain electrode drive circuit 19, timing generation circuit 20, and a power supply circuit (not shown). Data electrode drive circuit 17 is connected to one ends of data electrodes 12 in PDP 100. Data electrode drive circuit 17 has a plurality of data drivers made up of semiconductor elements for supplying voltages to data electrodes 12. Data electrodes 12 are divided into a plurality of blocks, with several data electrodes 12 taken as one block. Data electrodes 12 in units of the blocks are connected with the plurality of data drivers in electrode extraction sections provided at a lower end of PDP 100.

In FIG. 4, image signal processing circuit 16 converts image signal sig to image data with respect to each subfield. Data electrode drive circuit 17 converts image data with respect to each subfield to signals corresponding to respective data electrodes A1 to Am, to drive respective data electrodes A1 to Am. Timing generation circuit 20 generates a variety of timing signals based on horizontal synchronizing signal H and vertical synchronizing signal V, and supplies the variety of timing signals to respective drive circuit blocks. Scan electrode drive circuit 18 supplies a drive voltage waveform to each of scan electrodes Y1 to Yn based on the timing signal. Sustain electrode drive circuit 19 supplies a drive voltage waveform to each of sustain electrodes X1 to Xn based on the timing signal. In addition, one ends of the sustain electrodes are commonly connected inside or outside PDP 100, and the commonly connected wiring is connected to sustain electrode drive circuit 19.

Figure 5:
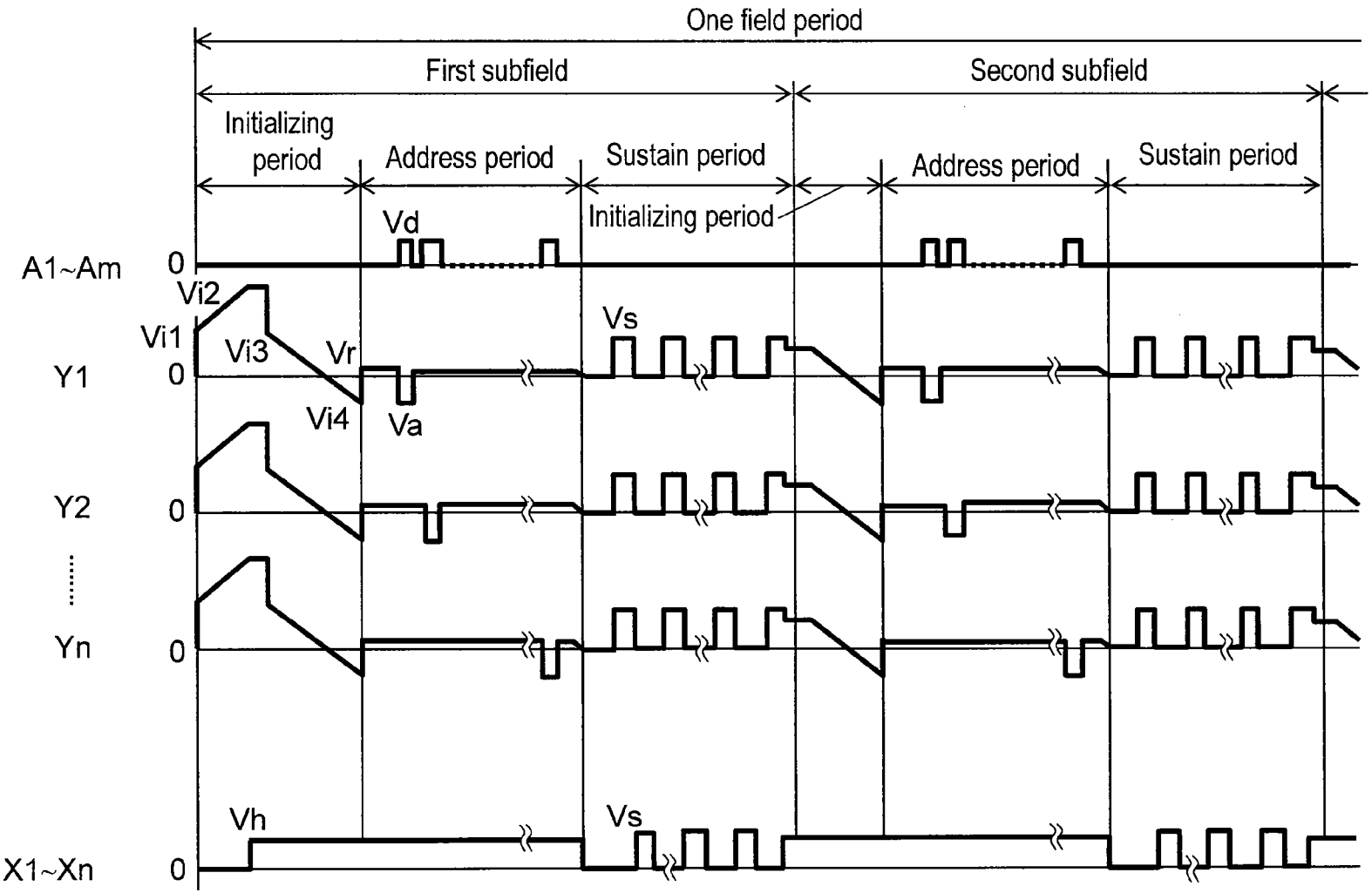
FIG. 5 is a waveform diagram showing waveforms of drive voltages to be applied to respective electrodes in the PDP according to the present exemplary embodiment.

Next, drive voltage waveforms for driving PDP 100 and operations thereof will be described with reference to FIG. 5.

In PDP 100 according to the present exemplary embodiment, one field is divided into a plurality of subfields, and each of the subfields has an initializing period, an address period and a sustain period.

In the initializing period of a first subfield, data electrodes A1 to Am and sustain electrodes X1 to Xn are held at 0(V). A ramp voltage, which gradually rises from voltage Vi1(V) being not higher than a discharge start voltage toward voltage Vi2(V) exceeding the discharge start voltage, is applied to scan electrodes Y1 to Yn. Then, first weak initializing discharge is generated in all discharge cells 15, and a negative wall voltage is accumulated on a top of each of scan electrodes Y1 to Yn. Further, a positive wall voltage is accumulated on a top of each of sustain electrodes X1 to Xn and data electrodes A1 to Am. Thereby, the wall voltage on the top of the electrode herein is a voltage generated by wall charges accumulated on the dielectric layer, the phosphor layer or the like which covers the electrodes.

Thereafter, sustain electrodes X1 to Xn are held at positive voltage Vh(V), and scan electrodes Y1 to Yn are each applied with a ramp voltage which gradually falls from voltage Vi3 (V) toward voltage Vi4(V). Thereupon, second weak initializing discharge is generated in all discharge cells 15. Thereby, the wall voltages between the tops of scan electrodes Y1 to Yn and the tops of sustain electrodes X1 to Xn are weakened, to be adjusted to values appropriate for an address operation. The wall voltages on the tops of data electrodes A1 to Am are also adjusted to values appropriate for the address operation.

In the subsequent address period, scan electrodes Y1 to Yn are temporarily held at Vr(V). Next, negative scan pulse voltage Va(V) is applied to scan electrode Y1 on a first row. Further, positive address pulse voltage Vd(V) is applied to data electrode Ak (k=1 to m) in discharge cell 15 to be displayed on the first row out of data electrodes A1 to Am. At this time, a voltage at an intersecting section of data electrode Ak and scan electrode Y1 is one obtained by adding the wall voltage on the top of data electrode Ak and the wall voltage on the top of scan electrode Y1 to external applied voltage (Vd−Va)(V), and it exceeds the discharge start voltage. Then, address discharge is generated between data electrode Ak and scan electrode Y1, and between sustain electrode X1 and scan electrode Y1. Thereby, the positive wall voltage is accumulated on the top of scan electrode Y1 in this discharge cell 15, and the negative wall voltage is accumulated on the top of sustain electrode X1 therein. At this time, the negative wall voltage is also accumulated on the top of data electrode Ak.

In this manner, the address discharge is generated in discharge cell 15 to be displayed on the first row, and the address operation is performed to accumulate the wall voltage on the top of each electrode. Meanwhile, voltages at the intersecting sections of data electrodes A1 to Am and scan electrode Y1, to which the address pulse voltage Vd(V) has not been applied, do not exceed the discharge start voltage, and hence the address discharge is not generated. The above address operation is sequentially performed up to discharge cell 15 on an n-th row, and the address period is completed.

In the subsequent sustain period, positive sustain pulse voltage Vs(V) as a first voltage is applied to each of scan electrodes Y1 to Yn. A ground potential, namely 0(V), is applied as a second voltage to each of sustain electrodes X1 to Xn. At this time, in discharge cell 15 where the address discharge has been generated, a voltage between the top of scan electrode Yi (i=1 to n) and the top of sustain electrode Xi is one obtained by adding the wall voltage on the top of scan electrode Yi and the wall voltage on the top of sustain electrode Xi to sustain pulse voltage Vs(V), and it exceeds the discharge start voltage. Then, sustain discharge is generated between scan electrode Yi and sustain electrode Xi, and by means of ultraviolet rays generated at this time, the phosphor layer emits light. Then, the negative wall voltage is accumulated on the top of scan electrode Yi, and the positive wall voltage is accumulated on the top of sustain electrode Xi. At this time, the positive wall voltage is also accumulated on data electrode Ak.

In discharge cell 15 where the address discharge has not been generated in the address period, the sustain discharge is not generated, and the wall voltage at the end of the initializing period is held. Subsequently, 0(V) as the second voltage is applied to each of scan electrodes Y1 to Yn. Sustain pulse voltage Vs (V) as the first voltage is applied to each of sustain electrodes X1 to Xn. Then, in discharge cell 15 where the sustain discharge has been generated, a voltage between the top of sustain electrode Xi and the top of scan electrode Yi exceeds the discharge start voltage, and hence sustain discharge is generated again between sustain electrode Xi and scan electrode Yi. Then, the negative wall voltage is accumulated on the top of sustain electrode Xi, and the positive wall voltage is accumulated on the top of scan electrode Yi.

Hereinafter, as in the above, sustain pulses in the number corresponding to luminance weight are alternately applied to scan electrodes Y1 to Yn and sustain electrodes X1 to Xn, whereby the sustain discharge is continuously performed in discharge cell 15 where the address discharge has been generated in the address period. In this manner, the sustain operation in the sustain period is completed. Since operations in the initializing period, the address period and the sustain period in and after a subsequent subfield are almost the same as the operations in the first subfield, descriptions of those operations are omitted.

Next, a configuration of display electrode 7 in PDP 100 according to the present exemplary embodiment will be described in more detail with respect to FIG. 6. Vertical barrier rib 13*a* and horizontal barrier rib 13*b* according to FIG. 6 are shown on the back side of display electrode 7 on the paper for the sake of convenience in description. However, actual vertical barrier rib 13*a* and horizontal barrier rib 13*b* are arranged on the front side of display electrode 7 on the paper.

As shown in FIG. 6, display electrode 7 is configured of scan electrode 5 and sustain electrode 6. Scan electrode 5 is made up of first transparent electrode 5*a* and first bus electrode 5*b*. Sustain electrode 6 is made up of second transparent electrode 6*c*, third transparent electrode 6*a*, and second bus electrode 6*b*.

First transparent electrode 5*a*, second transparent electrode 6*c* and third transparent electrode 6*a* are formed on front plate 1. A plurality of first transparent electrodes 5*a* is formed in parallel with horizontal barrier rib 13*b*. A plurality of second transparent electrodes 6*c* is formed in parallel with vertical barrier rib 13*a*. A plurality of third transparent electrodes 6*a* is formed in parallel with horizontal barrier rib 13*b*. Third transparent electrodes 6*a* are electrically connected with both ends of the plurality of second transparent electrodes 6*c*.

Further, a plurality of first bus electrodes 5*b* and second bus electrodes 6*b* is formed on front plate 1. First bus electrode 5*b* is electrically connected with first transparent electrode 5*a*. Second bus electrode 6*b* is electrically connected with the plurality of second transparent electrodes 6*c*. Second bus electrode 6*b* is formed in a position opposed to horizontal barrier rib 13*b*. First bus electrodes 5*b* and second bus electrodes 6*b* have the same width and are arranged with the same interval. That is, width W1 of first bus electrode 5*b* is the same as width W2 of second bus electrode 6*b*. Further, interval S1 between first bus electrode 5*b* and second bus electrode 6*b* is the same as interval S2 between adjacent first bus electrodes 5*b*. First bus electrode 5*b* and second bus electrode 6*b* are formed in an order of second bus electrode 6*b*, first bus electrode 5*b* and second bus electrode 6*b*. Interval W3 between second bus electrode 6*b* and third transparent electrode 6*a*, out of third transparent electrodes 6*a* formed at both-side ends of second transparent electrode 6*c*, is the same as interval W4 between second bus electrode 6*b* and the other third transparent electrode 6*a*. A plurality of third transparent electrodes 6*a* is formed in parallel with second bus electrode 6*b*. A plurality of discharge gaps is provided between first transparent electrode 5*a* and third transparent electrode 6*a*.

As thus described, PDP 100 of the present exemplary embodiment is configured such that second bus electrode 6*b* is formed in a position opposed to horizontal barrier rib 13*b*. With this configuration, second bus electrode 6*b* of sustain electrode 6 constituting discharge cell 15 does not exist inside discharge cell 15, whereby it is possible to improve an opening rate of discharge cell 15. Herewith, PDP 100 of the present exemplary embodiment can improve the efficiency in extracting light from discharge cell 15, so as to improve emission efficiency.

Further, PDP 100 of the present exemplary embodiment is configured such that first bus electrodes 5*b* and second bus electrodes 6*b* are formed with the same width and the same interval. Therefore, when PDP 100 is not turned on, first bus electrode 5*b* and second bus electrode 6*b* are inconspicuous. That is, PDP 100 of the present exemplary embodiment can suppress recognition of first bus electrode 5*b* and second bus electrode 6*b* as a striped pattern. Further, even with first bus electrode 5*b* and second bus electrode 6*b* having a black pigment, the PDP can suppress recognition of first bus electrode 5*b* and second bus electrode 6*b* as the striped pattern.

It should be noted that second transparent electrode 6*c* may be formed in parallel with vertical barrier rib 13*a* and on one side of second bus electrode 6*b*. Third transparent electrode 6*a* may be formed in parallel with second bus electrode 6*b* and at one ends of the plurality of second transparent electrodes 6*c*. In that case, scan electrode 5 and sustain electrode 6 can be formed in an order of scan electrode 5, sustain electrode 6, scan electrode 5 and sustain electrode 6.

Figure 7:
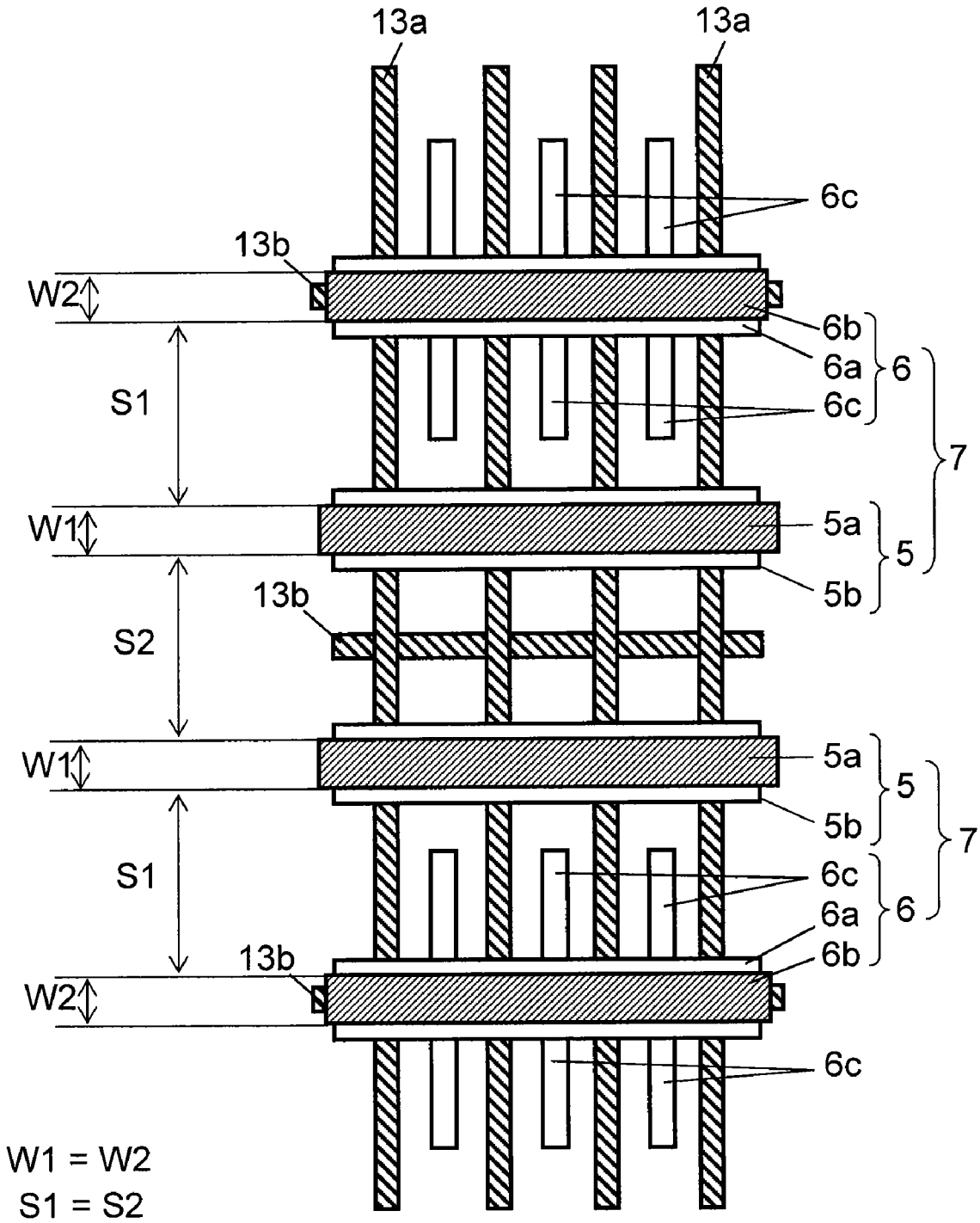
FIG. 7 is a plan view showing another example of the arrangement relation among scan electrodes and sustain electrodes, which constitute display electrodes, and barrier ribs in the PDP according to the present exemplary embodiment.

Moreover, FIG. 7 shows another exemplary embodiment. Although barrier ribs 13 shown in FIG. 7 is originally arranged on the front side on the paper, those are shown on the back of scan electrode 5 and sustain electrode 6 for the sake of convenience in description. As shown in FIG. 7, third transparent electrode 6*a* may be formed in a position opposed to horizontal barrier rib 13*b*. Scan electrode 5 is made up of first transparent electrode 5*a* and first bus electrode 5*b*. Sustain electrode 6 is made up of second transparent electrode 6*c*, third transparent electrode 6*a*, and second bus electrode 6*b*.

First transparent electrode 5*a*, second transparent electrode 6*c* and third transparent electrode 6*a* are formed on front plate 1. A plurality of first transparent electrodes 5*a* is formed in parallel with horizontal barrier rib 13*b*. A plurality of second transparent electrodes 6*c* is formed in parallel with vertical barrier rib 13*a*. Third transparent electrode 6*a* is formed in a position opposed to horizontal barrier rib 13*b*. Third transparent electrode 6*a* is electrically connected with the plurality of second transparent electrodes 6*c*. Third transparent electrode 6*a* is electrically connected with second bus electrode 6*b*.

Further, a plurality of first bus electrodes 5*b* and second bus electrodes 6*b* is formed on front plate 1. First bus electrode 5*b* is electrically connected with first transparent electrode 5*a*. Second bus electrode 6*b* is electrically connected with the plurality of second transparent electrodes 6*c*. Second bus electrode 6*b* is formed in a position opposed to horizontal barrier rib 13*b*. First bus electrodes 5*b* and second bus electrodes 6*b* have the same width and are arranged with the same interval. That is, width W1 of first bus electrode 5*b* is the same as width W2 of second bus electrode 6*b*. Further, interval S1 between first bus electrode 5*b* and second bus electrode 6*b* is the same as interval S2 between adjacent first bus electrodes 5*b*. First bus electrode 5*b* and second bus electrode 6*b* are formed in an order of second bus electrode 6*b*, first bus electrode 5*b* and second bus electrode 6*b*. A plurality of discharge gaps is provided between first transparent electrode 5*a* and second transparent electrode 6*c*.

Although another exemplary embodiment has been illustrated in FIG. 7, the exemplary embodiment is not restricted to this configuration. As still another exemplary embodiment, third transparent electrode 6*a* may not be formed. However, formation of third transparent electrode 6*a* increases a contact area between second transparent electrode 6*c* and third transparent electrode 6*a*. The increase in contact area results in reduction in contact resistance between second transparent electrode 6*c* and third transparent electrode 6*a*. Herewith, PDP 100 formed with third transparent electrodes 6*a* can reduce a voltage required for generation of sustain discharge than PDP 100 not formed with third transparent electrodes 6*a*.

As thus described, by arrangement of first bus electrodes 5*b* and second bus electrodes 6*b* with the same width and the same interval, PDP 100 of the present exemplary embodiment can suppress recognition of first bus electrode 5*b* and second bus electrode 6*b* as the striped pattern when PDP 100 is not turned on. Further, by formation of second bus electrode 6*b* in the position opposed to horizontal barrier rib 13*b*, PDP 100 of the present exemplary embodiment can improve the efficiency in extracting light from discharge cell 15, so as to improve emission efficiency.

INDUSTRIAL APPLICABILITY

As described above, the technique of the present disclosure is useful in enhancing appearance of a plasma display panel when it is turned off.

REFERENCE MARKS IN THE DRAWING

1 front plate
2 rear plate
3 discharge space
4, 10 substrate
5 scan electrode
5*a* first transparent electrode
5*b* first bus electrode
6 sustain electrode
6*a* third transparent electrode
6*b* second bus electrode
6*c* second transparent electrode
7 display electrode
8 dielectric layer
9 protective layer
11 insulating layer
12 data electrode
13 barrier rib
13*a* vertical barrier rib
13*b* horizontal barrier rib
14R, 14G, 14B phosphor layer
15 discharge cell
16 image signal processing circuit
17 data electrode drive circuit
18 scan electrode drive circuit
19 sustain electrode drive circuit
20 timing generation circuit
100 PDP
200 plasma display device

The invention claimed is:

1. A plasma display panel, comprising:
a rear plate; and
a front plate disposed oppositely to the rear plate, wherein
the rear plate has a vertical barrier rib and a horizontal barrier rib orthogonal to the vertical barrier rib,
the front plate has a first transparent electrode in parallel with the horizontal barrier rib and a plurality of second transparent electrodes in parallel with the vertical barrier rib,
the front plate further has a plurality of bus electrodes each of which has an equal width to each other and the bus electrodes are arranged at an equal interval therebetween,
the plurality of bus electrodes includes a first bus electrode electrically connected with the first transparent electrode, and a second bus electrode electrically connected with the plurality of second transparent electrodes,
the second bus electrode is formed in a position opposed to the horizontal barrier rib, and
the front plate further has a third transparent electrode that connects the plurality of second transparent electrodes electrically with each other.

2. The plasma display panel according to claim 1, wherein
the third transparent electrode is formed in a position opposed to the horizontal barrier rib.

3. The plasma display panel according to claim 1, wherein
the third transparent electrode is formed in parallel with the second bus electrode on at least first ends of the plurality of second transparent electrodes.

4. The plasma display panel according to claim 3, wherein
the front plate has at least two third transparent electrodes,
one of the third transparent electrodes is formed on the first ends of the plurality of second transparent electrodes, and
another third transparent electrode is formed on second ends of the plurality of second transparent electrodes.

5. The plasma display panel according to claim 4, wherein
an interval between the one of the third transparent electrode and the second bus electrode is equal to an interval between the another third transparent electrode and the second bus electrode.

* * * * *